US009324525B2

(12) United States Patent
Yamauchi et al.

(10) Patent No.: US 9,324,525 B2
(45) Date of Patent: Apr. 26, 2016

(54) ELECTROMAGNETIC RELAY

(71) Applicant: OMRON Corporation, Kyoto-shi, Kyoto (JP)

(72) Inventors: Hideto Yamauchi, Kumamoto (JP); Yoshiaki Mimura, Kumamoto (JP); Hironori Sanada, Kumamoto (JP)

(73) Assignee: OMRON Corporation, Kyoto-shi, Kyoto (JP)

( * ) Notice: Subject to any disclaimer, the term of this patent is extended or adjusted under 35 U.S.C. 154(b) by 0 days.

(21) Appl. No.: 14/166,964

(22) Filed: Jan. 29, 2014

(65) Prior Publication Data

US 2014/0253266 A1 Sep. 11, 2014

(30) Foreign Application Priority Data

Mar. 8, 2013 (JP) ..... 2013-046860

(51) Int. Cl.

| | |
|---|---|
| ***H01H 51/22*** | (2006.01) |
| ***H01H 50/54*** | (2006.01) |
| ***H01H 1/34*** | (2006.01) |
| ***H01H 49/00*** | (2006.01) |
| ***H01H 50/34*** | (2006.01) |

(52) U.S. Cl.

CPC ..... *H01H 50/54* (2013.01); *H01H 1/34* (2013.01); *H01H 49/00* (2013.01); *H01H 50/34* (2013.01)

(58) Field of Classification Search

CPC ..... H01H 50/14
USPC ..... 335/78–83
See application file for complete search history.

(56) References Cited

U.S. PATENT DOCUMENTS

| | | | | | |
|---|---|---|---|---|---|
| 4,959,627 | A | * | 9/1990 | Iizumi et al. | 335/106 |
| 5,274,348 | A | * | 12/1993 | Vernier et al. | 335/78 |
| 5,392,015 | A | * | 2/1995 | Matsuoka et al. | 335/78 |
| 5,673,012 | A | * | 9/1997 | Stadler et al. | 335/78 |
| 5,757,255 | A | * | 5/1998 | Noda et al. | 335/78 |
| 6,002,312 | A | * | 12/1999 | Dittmann et al. | 335/78 |

(Continued)

FOREIGN PATENT DOCUMENTS

| | | | |
|---|---|---|---|
| EP | 1049126 | A2 | 11/2000 |
| EP | 1246214 | A2 | 10/2002 |

(Continued)

OTHER PUBLICATIONS

Extended European Search Report in counterpart European Application No. 14151060.2 dated May 30, 2014 (7 pages).

(Continued)

*Primary Examiner* — Alexander Talpalatski
(74) *Attorney, Agent, or Firm* — Osha Liang LLP

(57) ABSTRACT

An electromagnetic relay has a base having an upper surface, an electromagnet block, formed by winding a coil around a spool with at least one end provided with a guard portion and inserting an iron core through a through hole of the spool, mounted on the upper surface of the base such that a shaft center of the iron core is parallel to the base, a movable contact, provided at a free end of a movable touch piece that rotates based on magnetization and demagnetization of the electromagnet block, that is brought into contact with or separated from a fixed contact, and a press-fitting portion that is press-fitted into a press-fitting hole provided at the edge of the outward surface of the guard portion along the shaft center of the iron core. The press-fitting portion extends to the lateral side from a fixed contact terminal that has the fixed contact.

7 Claims, 10 Drawing Sheets

(56) References Cited

U.S. PATENT DOCUMENTS

| | | | | |
|---|---|---|---|---|
| 6,116,558 | A * | 9/2000 | Yano | 248/316.7 |
| 6,225,880 | B1 | 5/2001 | Kern | |
| 6,337,614 | B1 * | 1/2002 | Tsutsui | 335/160 |
| 6,359,537 | B1 | 3/2002 | Ichikawa et al. | |
| 6,781,490 | B2 * | 8/2004 | Funayama et al. | 335/78 |
| 6,995,639 | B2 * | 2/2006 | Minowa et al. | 335/83 |
| 8,362,857 | B2 * | 1/2013 | Tsutsui et al. | 335/78 |
| 2002/0036556 | A1 * | 3/2002 | Matsuda | 335/78 |

FOREIGN PATENT DOCUMENTS

| | | | |
|---|---|---|---|
| JP | 2001-521273 | A | 11/2001 |
| JP | 2004-071582 | A | 3/2004 |
| JP | 2007-207601 | A | 8/2007 |

OTHER PUBLICATIONS

Examination Report in corresponding Chinese Patent Application No. 201410042854.6 dated Jul. 24, 2015, with translation (10 pages).

* cited by examiner

ELECTROMAGNETIC RELAY

BACKGROUND OF THE INVENTION

1. Technical Field

The present invention relates to an electromagnetic relay, and especially to a structure for fitting a fixed contact terminal.

2. Related Art

As a conventional electromagnetic relay, for example, there is one formed by erecting a first fixed contact support 4 and a contact spring connection pin 5 in parts extending from a first flange 12 of a coil body 1, as shown in FIGS. 1 and 2 of Japanese Unexamined Patent Application Publication (Translation of PCT Application) No. 2001-521273.

SUMMARY

However, when an attempt is made to reduce a size, especially a floor area, of the foregoing electromagnetic relay, it is not possible to reduce the size due to difficulties in ensuring spaces to install the first fixed contact support 4 and the contact spring connection pin 5.

One or more embodiments of the present invention provides an electromagnetic relay with a small floor area.

An electromagnetic relay according to one or more embodiments of the present invention is an electromagnetic relay in which an electromagnet block, formed by winding a coil around a spool with at least one end provided with a guard portion and inserting an iron core through a through hole of the spool, is mounted on the upper surface of a base such that a shaft center of the iron core is in parallel with the base, and a movable contact, provided at a free end of a movable touch piece configured to rotate based on magnetization and demagnetization of the electromagnet block, is brought into contact with or separated from a fixed contact, wherein a press-fitting portion is press-fitted into a press-fitting hole provided at the edge of the outward surface of the guard portion along the shaft center of the iron core, the press-fitting portion extending to the lateral side from a fixed contact terminal that has the fixed contact.

According to one or more embodiments of the present invention, the fixed contact terminal can be press-fitted and fixed to the guard portion of the spool, whereby it is possible to save the space to install the fixed contact terminal, so as to obtain an electromagnetic relay with a smaller floor area than that of the conventional example.

According to one or more embodiments of the present invention, the fixed contact may be arranged between a pair of press-fitting portions extending in parallel.

According to one or more embodiments of the present invention, a pair of press-fitting portions of the fixed contact terminal is respectively press-fitted into the press-fitting holes of the spool, whereby the fixed contact can be firmly supported. Hence it is possible to obtain an electromagnetic relay with high alignment accuracy and no dispersion of operation characteristics.

According to one or more embodiments of the present invention, the fixed contact terminal may be at least either one of a normally open fixed contact terminal and a normally closed fixed contact terminal respectively having a normally open fixed contact and a normally closed fixed contact which are opposed to each other with the movable contact provided therebetween.

According to one or more embodiments of the present invention, it is possible to obtain an electromagnetic relay having the normally open fixed contact and/or the normally closed fixed contact, and having a small floor area.

According to one or more embodiments of the present invention, the fixed contact terminals are a normally closed fixed contact terminal and a normally open fixed contact terminal respectively having a normally closed fixed contact and a normally open fixed contact which are opposed to each other with the movable contact provided therebetween, and press-fitting holes to be press-fitted with press-fitting portions of the normally closed fixed contact terminal and the normally open fixed contact terminal may be arranged in upper and lower parts at the edge of the front surface of the guard portion.

According to one or more embodiments of the present invention, the press-fitting portions of the normally closed fixed contact terminal and the normally open fixed contact terminal are arranged in the upper and lower parts along the edge of the front surface of the guard portion, whereby it is possible to obtain an electromagnetic relay having a small lateral width as well as a small floor area.

According to one or more embodiments of the present invention, the press-fitting portions may be respectively cut from a pair of corners formed by bending each-side edge of the normally open fixed contact terminal in the same direction.

According to one or more embodiments of the present invention, there is exerted the effect of being able to obtain an electromagnetic relay having a normally open fixed contact terminal with high rigidity and a good material layout.

DETAILED DESCRIPTION

Embodiments of the present invention will be described in accordance with the accompanying drawing of FIGS. 1 to 10. In embodiments of the invention, numerous specific details are set forth in order to provide a more thorough understanding of the invention. However, it will be apparent to one of ordinary skill in the art that the invention may be practiced without these specific details. In other instances, well-known features have not been described in detail to avoid obscuring the invention.

Figure 2:
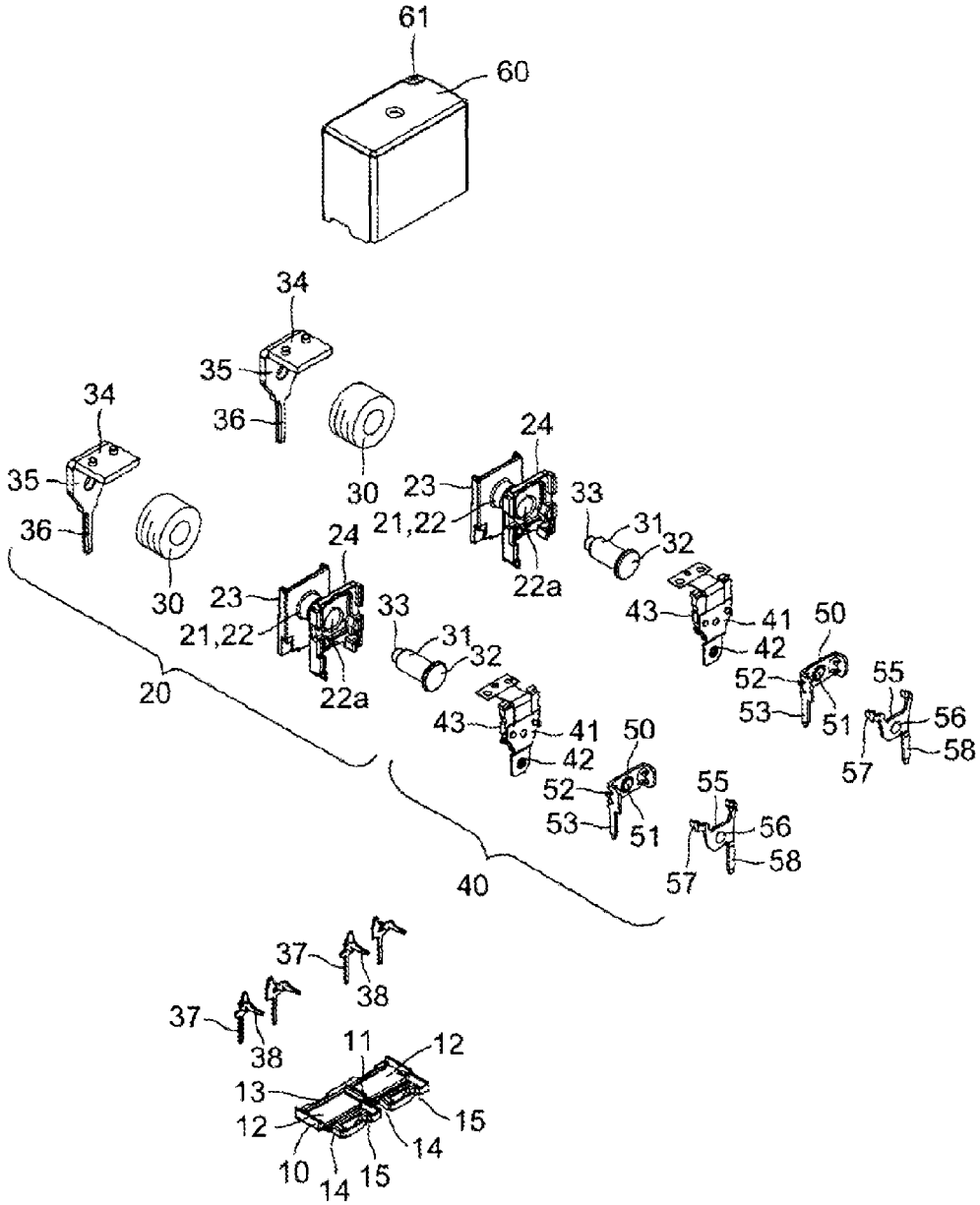
FIG. 2 is an exploded perspective view of the electromagnetic relay shown in FIG. 1A.
Figure 3:
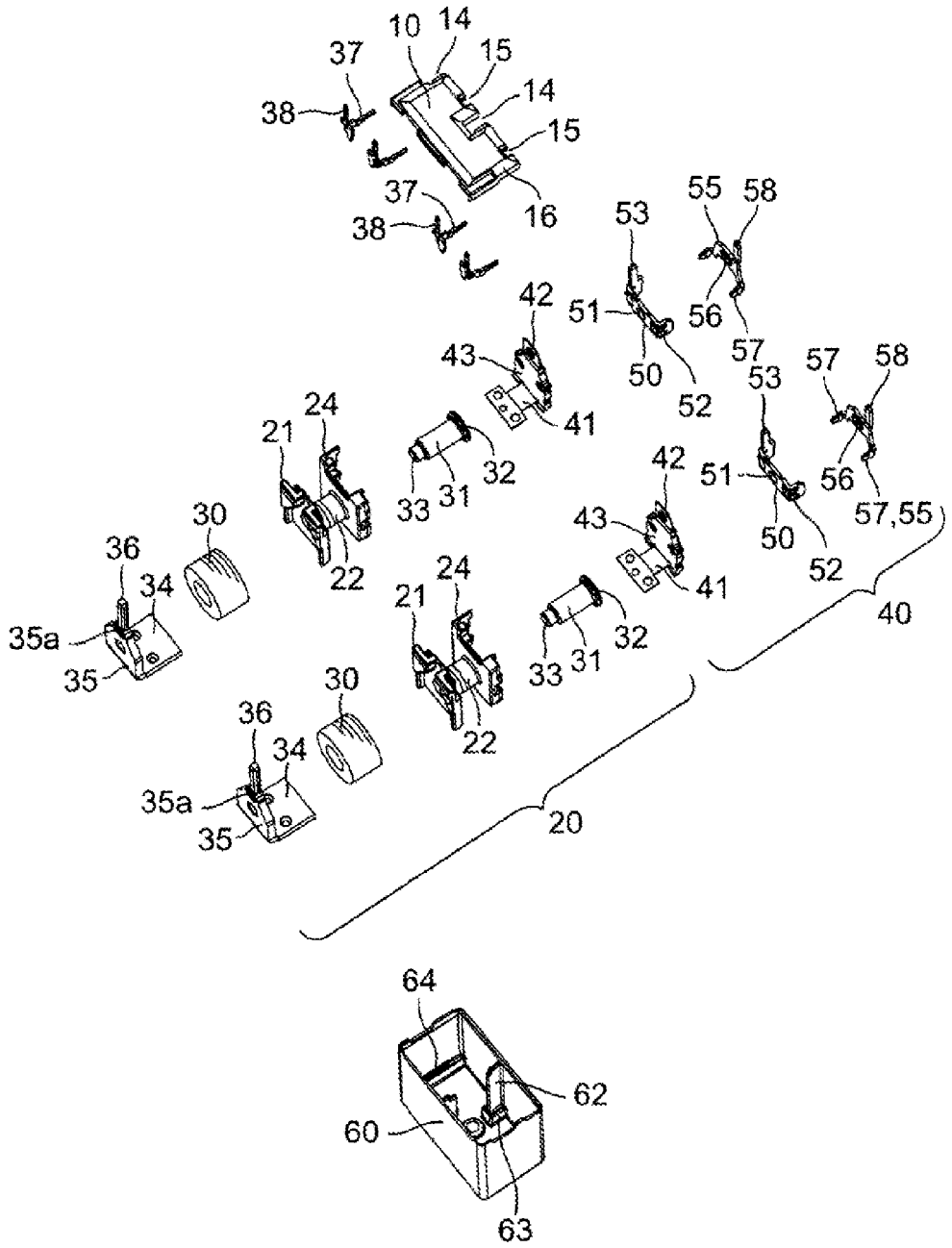
FIG. 3 is an exploded perspective view of the electromagnetic relay shown in FIG. 1B.

As shown in FIG. 2, an electromagnetic relay according to one or more embodiments of the present invention is configured of a base 10, a pair of electromagnet blocks 20 juxtaposed on the base 10, a contact mechanism portion 40 assembled into the base 10 and the electromagnet block 20, and a casing 60.

Figure 7A:
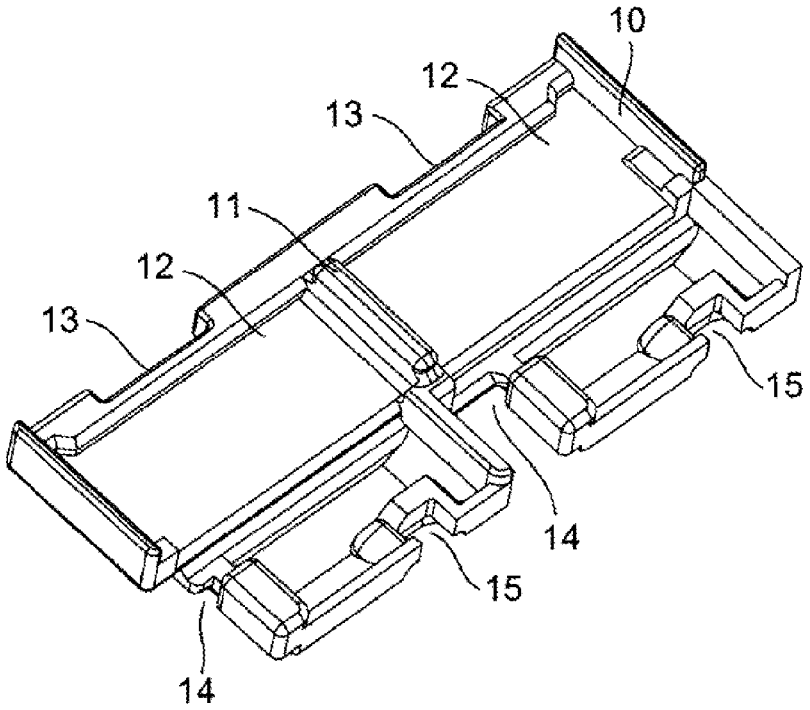
FIGS. 7A and 7B are respectively a perspective view, and a perspective view seen from a different angle, of a base shown in FIGS. 2 and 3.
Figure 7B:
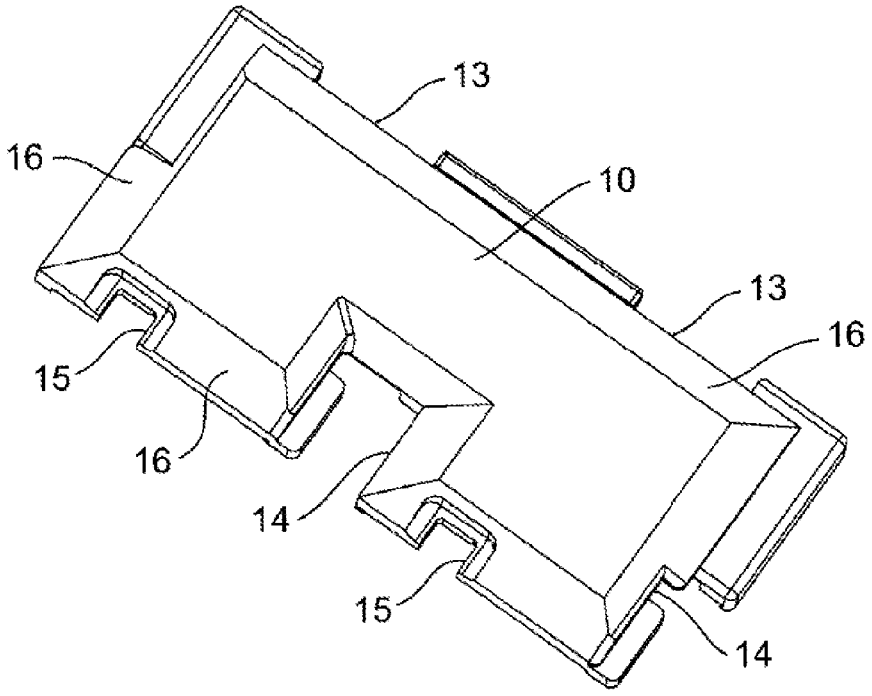

As shown in FIG. 7A, on the base 10, a pair of aligning recessed portions 12, 12 is formed while a partition portion 11 projectingly provided in a central part on the upper surface is placed therebetween. Further, at one-side edge out of mutually opposed both-side edges of the base 10, a pair of notches 13, 13 to be fitted with a seal-retaining rib 23*b* of a spool 21, which will be described later, are juxtaposed. Moreover, at the other-side edge of the base 10, notches 14, 15 are alternately juxtaposed, the notches being to be fitted with a terminal portion 53 of a normally open fixed contact terminal 50 and a terminal portion 58 of a normally closed fixed contact terminal 55 which will be described later. Furthermore, as shown in FIG. 7B, a continuous taper surface 16 is formed along an outer periphery of the rear surface of the base 10.

As shown in FIG. 2, the electromagnet block 20 is formed such that a coil 30 is wound around a body 22 of a spool 21 while an iron core 31 having a substantially T-shape in section is inserted through a through hole 22*a* of the body 22, and the projecting one end is made a magnetic pole portion 32 while the projecting other end 33 is caulked and fixed to a vertical portion 35 of a substantially L-shaped yoke 34. A seal-retaining projected portion 35*a* is projectingly provided on the outward surface of the vertical portion 35, and from the lower edge thereof, a movable contact terminal portion 36 provided with a chamfered portion 36*a* (FIGS. 4, 5) extends to the lower side.

Figures 4A, 4B:
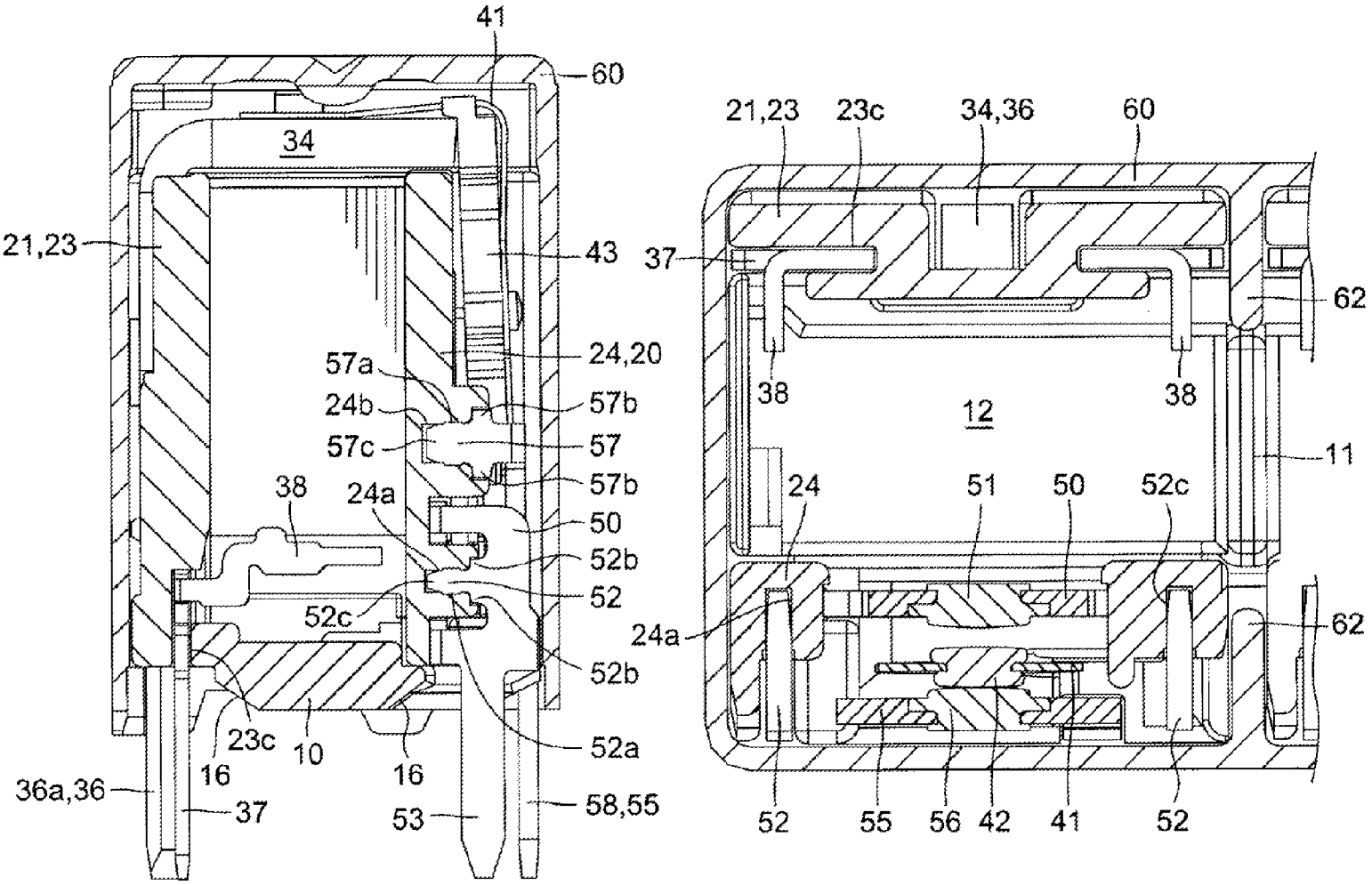
FIGS. 4A and 4B are respectively a longitudinal sectional view and a partial lateral sectional view of the electromagnetic relay shown in FIG. 1.
Figure 8A:
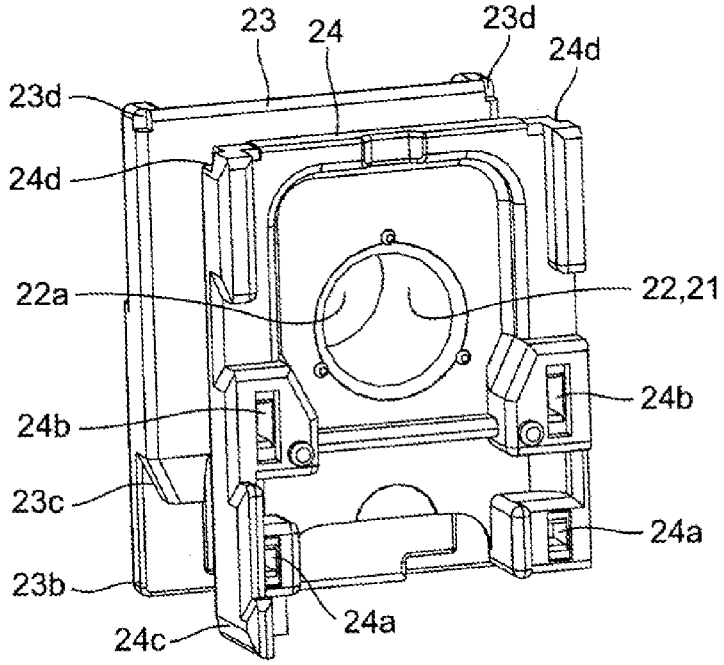
FIGS. 8A and 8B are respectively a perspective view, and a perspective view seen from a different angle, of a spool shown in FIGS. 2 and 3.
Figure 8B:
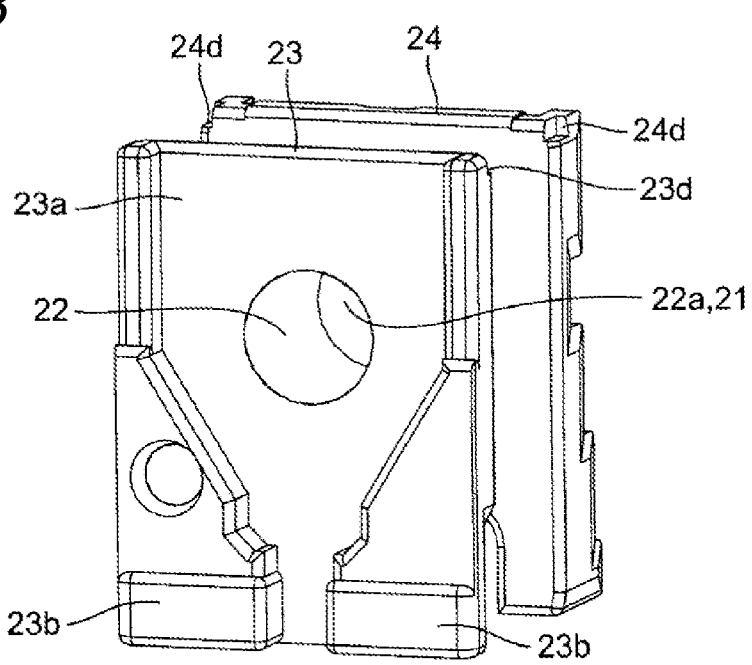

In particular, as shown in FIG. 8, the spool 21 has guard portions 23, 24 on both sides of the body 22, and a recessed portion 23*a* to be fitted with the yoke 34 is formed on the outward surface of the one guard portion 23, from the lower edge of which the seal-retaining rib 23*b* extends (FIG. 8B). Further, a press-fitting groove 23*c* where a coil terminal 37 can be press-fitted is provided on the side end surface of the guard portion 23 (FIG. 4A). Moreover, as shown in FIG. 8A, press-fitting holes 24*a*, 24*b* are provided in upper and lower parts at each-side edge of the outward surface of the other guard portion 24 in the spool 21. Furthermore, a seal-retaining rib 24*c* extends to the lateral side from a position adjacent to the press-fitting hole 24*a* at a side edge in the guard portion 24. Then, engaging receiving portions 23*d*, 24*d* are respectively provided at upper corners of the opposed surfaces of the guard portions 23, 24.

As shown in FIG. 2, the contact mechanism portion 40 is configured of a movable touch piece 41, the normally open fixed contact terminal 50 and the normally closed fixed contact terminal 55.

The movable touch piece 41 is made up of a conductive plate spring flexed in a substantially L-shape. One end thereof is provided with a movable contact 42, while a vertical portion thereof is caulked and fixed to a movable iron piece 43. Then, the other end of the movable touch piece 41 is caulked and fixed to a horizontal portion of the yoke 34, thereby to rotatably support the movable iron piece 43 and the movable touch piece 41 around the leading edge of the horizontal portion of the yoke 34 as a fulcrum.

Figure 9:
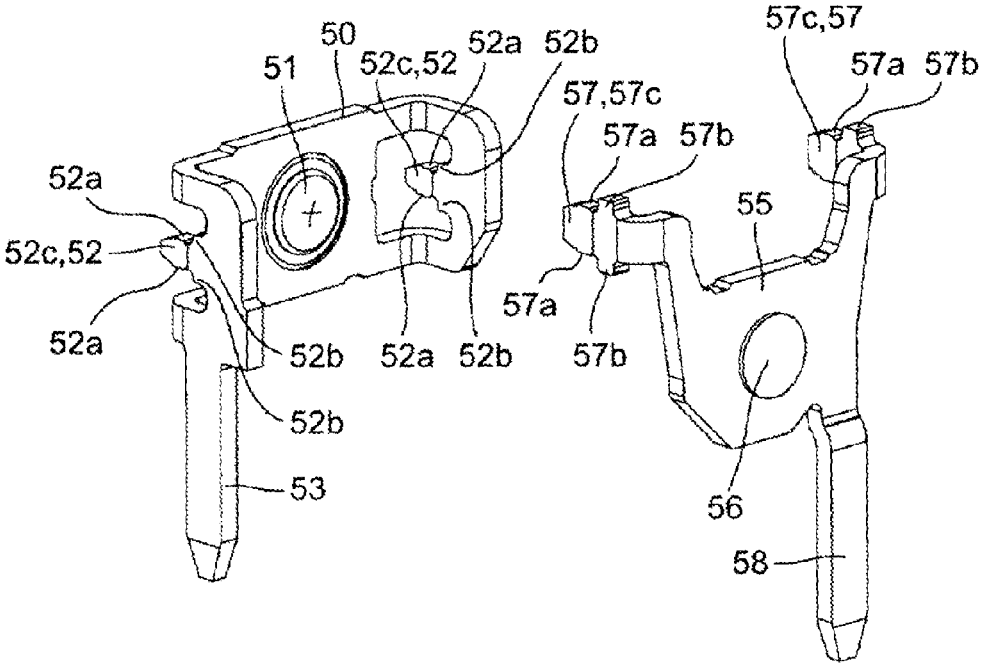
FIG. 9 is a perspective view of a normally open fixed contact terminal and a normally closed fixed contact terminal shown in FIGS. 2, 3.

In the normally open fixed contact terminal 50, as shown in FIG. 9, both-side edges located on both sides to a normally open fixed contact 51 having been caulked and fixed are flexed in parallel into a substantially C-shape in plain, and a press-fitting portion 52 is cut from the corner thereof, while a terminal portion 53 extends from the edge of one side thereof to the lower side. Press-fitting receiving portions 52*a* to come into press-contact with the press-fitting holes 24*a* of the spool 21 are provided in upper and lower parts in the press-fitting portion 52, while a push-out preventive rib 52*b* for preventing push-out of chips from the press-fitting hole 24*a* is provided on a base of the press-fitting receiving portion 52*a*. Further, a taper surface 52*c* for facilitating a press-fitting operation is formed on each side surface of the press-fitting portion 52.

In the normally closed fixed contact terminal 55, a pair of press-fitting portions 57 extends in parallel in a horizontal direction from the upper corners located to both sides of the normally closed fixed contact 56 having been caulked and fixed, and from the corner of the lower edge thereof, the terminal portion 58 extends to the lower side. Press-fitting receiving portions 57*a* to come into press-contact with the press-fitting holes 24*b* of the spool 21 are provided in upper and lower parts in the press-fitting portion 57, while a push-out preventive rib 57*b* for preventing push-out of chips from the press-fitting hole 24*b* is provided on a base of the press-fitting receiving portion 57*a*. Further, a taper surface 57*c* for facilitating a press-fitting operation is formed on each side surface of the press-fitting portion 57.

Figure 10A:
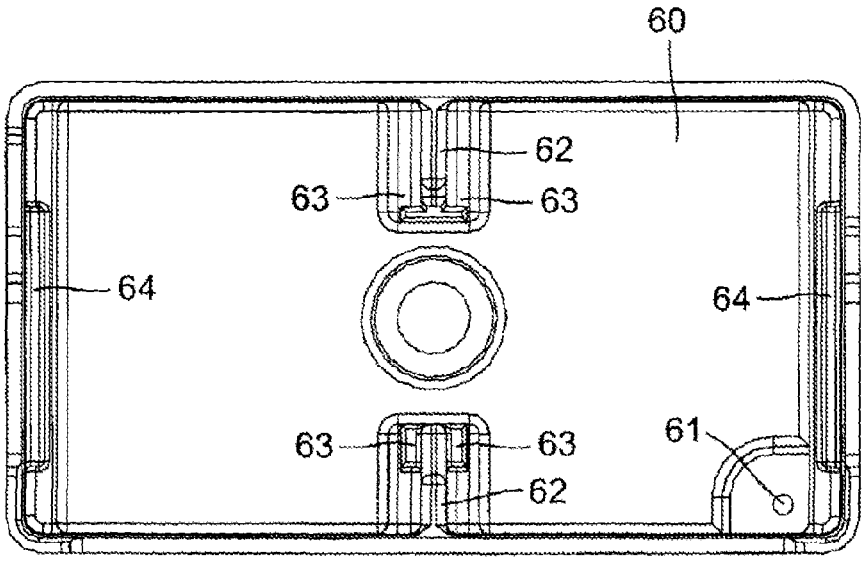
FIGS. 10A and 10B are respectively a bottom view and a longitudinal sectional perspective view of the casing shown in FIGS. 2, 3.
Figure 10B:
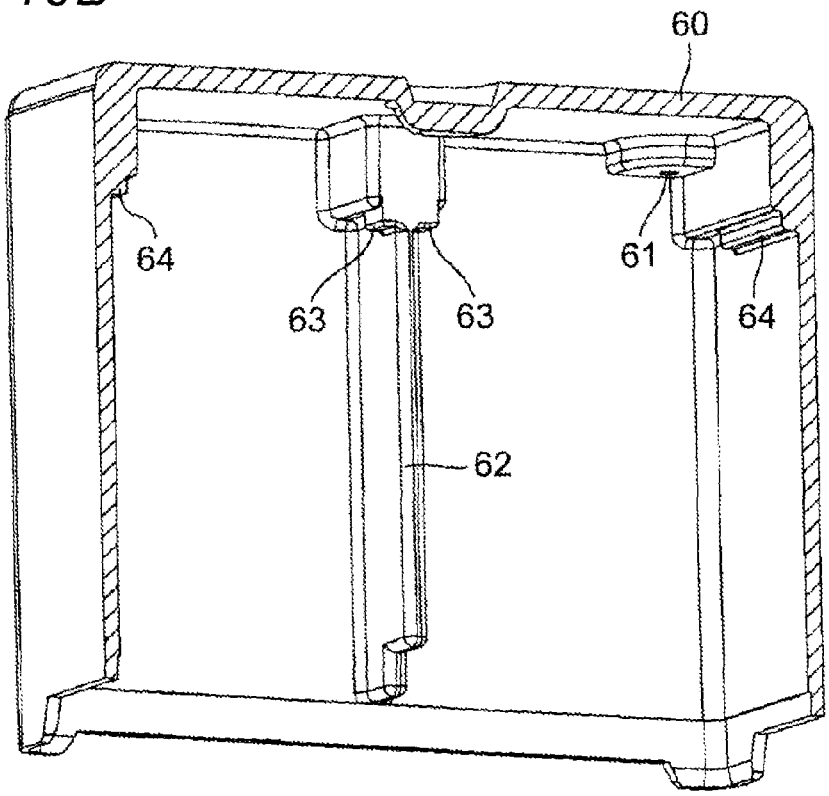

As shown in FIG. 2, the casing 60 has a box shape fittable to the base 10 where the electromagnet block 20 and the contact mechanism portion 40 are assembled, and a corner portion of the upper surface thereof has a gas vent hole 61. Further, as shown in FIG. 10, an insulating rib 62 is projectingly provided in a central portion on each of the opposed inner side surfaces of the casing 60, while a position-regulating projected portion 63 is provided on the base of the insulating rib 62. Moreover, position-regulating projected threads 64 as position-regulating projected portions are projectingly provided respectively at the opposed edges of the ceiling surface of the casing 60.

Next, a procedure for assembling the foregoing constitutional components will be described.

First, the coil 30 is wound around the body 22 of the spool 21, while a leader line thereof is bound to a binding portion 38 of the coil terminal 37 press-fitted into the press-fitting groove 23*c* of the guard portion 23 and soldered, and thereafter the binding portion 38 is bent inward. Then, the iron core 31 is inserted through the through hole 22*a* provided in the body 22 of the spool 21, and the projecting other end is caulked and fixed to the vertical portion 35 of the yoke 34, to complete the electromagnet block 20. Subsequently, the other end of the movable touch piece 41 caulked and fixed with the movable iron piece 43 is caulked and fixed to the horizontal portion of the yoke 34. Further, the press-fitting portion 52 of the normally open fixed contact terminal 50 is press-fitted into the press-fitting hole 24*a*, provided at the edge of the outward surface of the guard portion 24 of the electromagnet block 20, along the shaft center of the iron core 31, to contactably and separably arrange the movable contact 42 on the normally open fixed contact 51. At this time, a contact distance between the normally open fixed contact 51 of the normally open fixed contact terminal 50 and the movable contact 42 can be adjusted by means of a press-fitting amount of the press-fitting portion 52, thereby to allow adjustment of the operation characteristics such as an operating voltage and a restoration voltage.

Figure 1A:
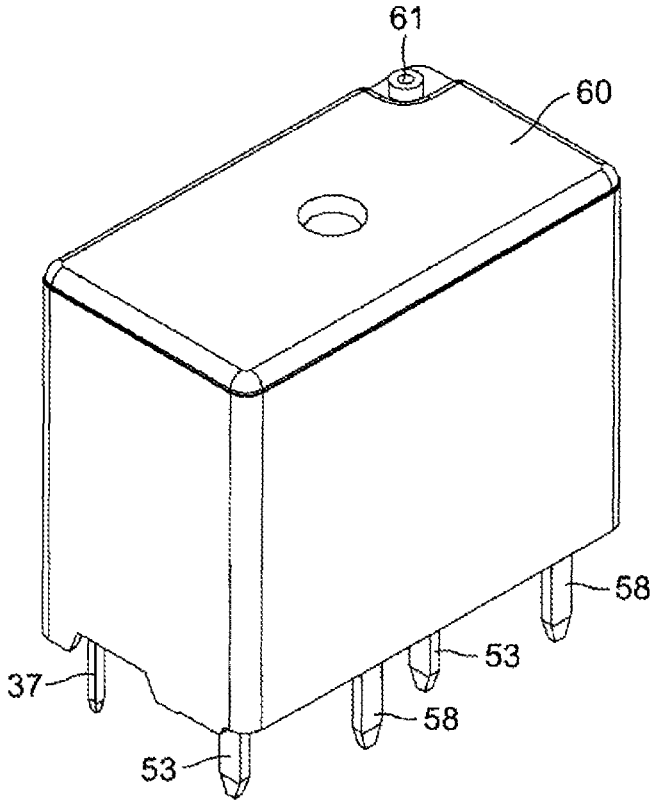
FIGS. 1A and 1B are respectively a perspective view and a perspective view seen from a different angle, showing an electromagnetic relay according to one or more embodiments of the present invention.

Subsequently, the electromagnet blocks 20, 20 are respectively aligned in the pair of aligning recessed portions 12, 12 of the base 10 such that the shaft center of the iron core 31 is in parallel with the upper surface of the base 10. Then, the seal-retaining rib 23*b* of the spool 21 is fitted to the notch 13 of the base 10 while the terminal portions 53, 58 of the normally open fixed contact terminal 50 and the normally closed fixed contact terminal 55 are fitted to the notches 14, 15 (FIGS. 1, 4).

Moreover, the press-fitting portion 57 of the normally closed fixed contact terminal 55 is press-fitted into the press-fitting hole 24*b* of the guard portion 24 along the shaft center of the iron core 31. A contact distance between the normally closed fixed contact 56 of the normally closed fixed contact terminal 55 and the movable contact 42 can be adjusted by means of a press-fitting amount of the press-fitting portion 57 at this time, thereby to allow adjustment of the operation characteristics such as an operating voltage and a restoration voltage.

According to one or more embodiments of the present invention, the operation characteristics can be accurately adjusted while the press-fitting portion 57 of the normally closed fixed contact terminal 55 is press-fitted into the press-fitting hole 24*b* of the spool 21, thereby to facilitate an assembly operation and an adjustment operation, leading to improvement in productivity and yield. For this reason, internal constitutional components are not required to have high dimensional accuracy, thereby to facilitate manufacturing of the internal constitutional components. It is to be noted that the internal constitutional components refer to components constituting the electromagnet block, such as the coil wound around the spool, the iron core and the yoke, and components constituting the contact mechanism portion such as the movable touch piece and the fixed touch piece.

Further, since the press-fitting portions 52, 57 can be press-fitted into the press-fitting holes 24*a*, 24*b* arranged in upper and lower parts along each-side edge of the guard portion 24, it is possible to save spaces to install the normally open fixed contact terminal 50 and the normally closed fixed contact terminal 55, so as to obtain an electromagnetic relay with a small floor area, especially a small lateral width.

It is to be noted that, although the configuration has been formed where the contacts are arranged in the order of the normally open fixed contact 51, the movable contact 42 and the normally closed fixed contact 56 from the side close to the electromagnet block 20 (cf. FIG. 6), the order of the normally open fixed contact and the normally closed fixed contact can be changed, or either one fixed contact may be omitted.

Figure 5B:
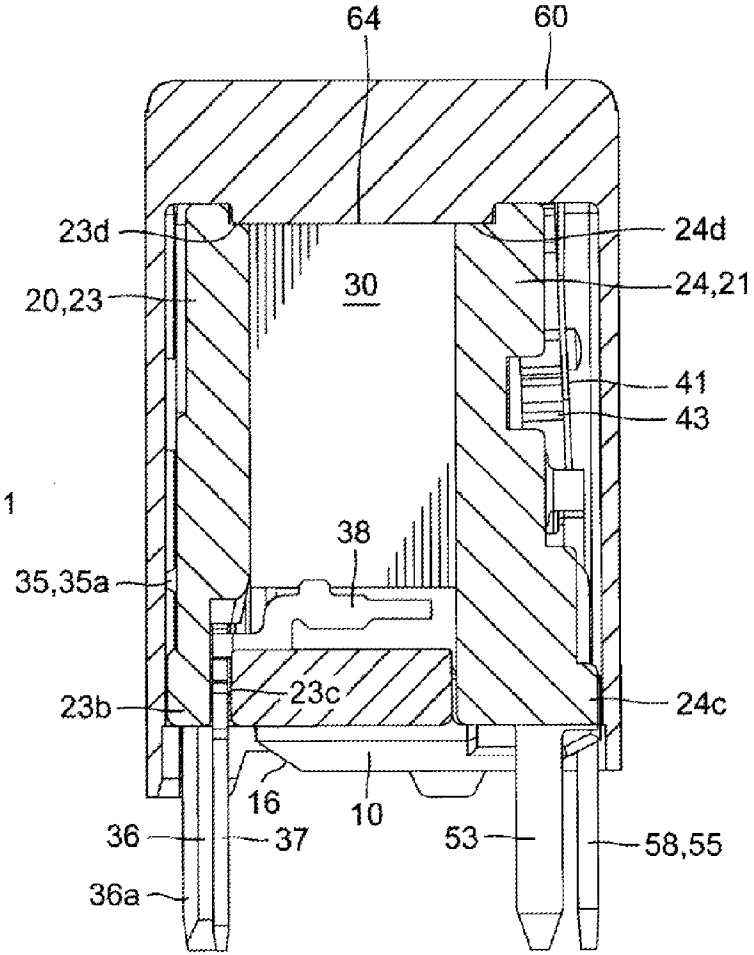
FIGS. 5A and 5B are longitudinal sectional views showing an assembled state of a casing shown in FIG. 1.
Figure 5A:
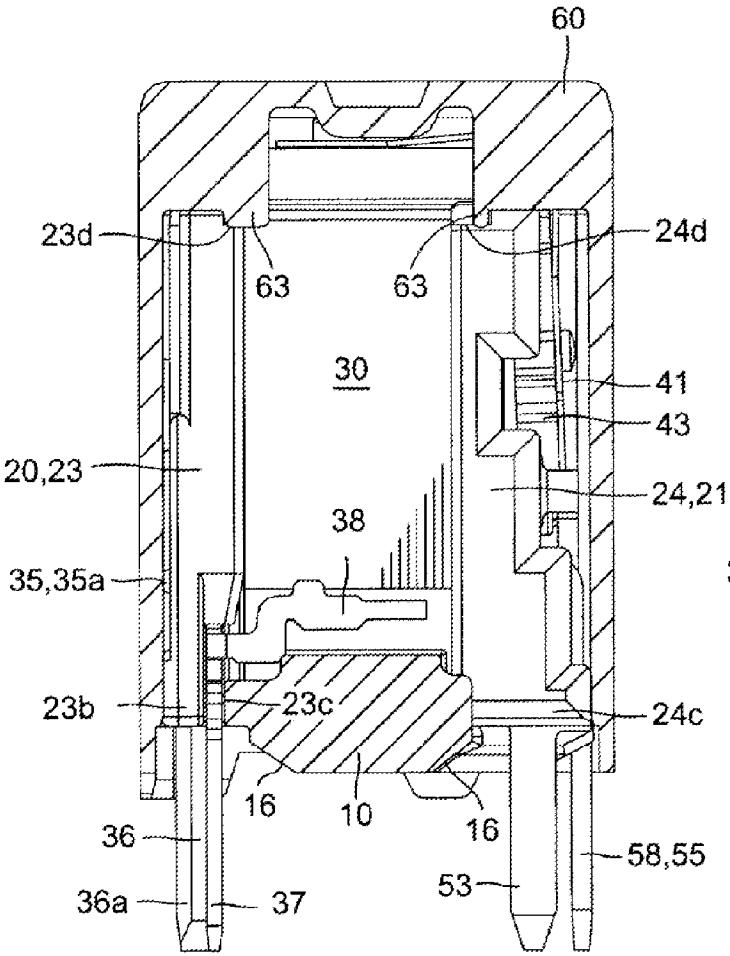

Then, by fitting the casing 60 to the base 10, the pair of electromagnet blocks 20, 20 is partitioned by the insulating rib 62 (FIG. 4B), the position-regulating projected portion 63 and the position-regulating projected thread 64, provided in the casing 60, are fitted to the engaging receiving portions 23*d*, 24*d* of the guard portions 23, 24, to regulate the positions (FIG. 5).

According to one or more embodiments of the present invention, it is possible to accurately align the electromagnet blocks 20, 20 in predetermined positions on the base 10, so as to obtain an electromagnetic relay with little dispersion of operation characteristics.

Further, according to one or more embodiments of the present invention, as shown in FIG. 5B, the engaging receiving portions 23*d*, 24*d* are left-right asymmetric, which is a structure capable of preventing wrong assembly.

It is to be noted that, although the case has been described where a total of four engaging receiving portions 23*d*, 24*d* are provided in the guard portions 23, 24, at least one engaging receiving portion may be provided, and two or three may be provided. Especially in the case of providing two engaging receiving portions, it may be beneficial to arrange those on a diagonal line. However, the present invention is not limited to such a configuration.

Figure 1B:
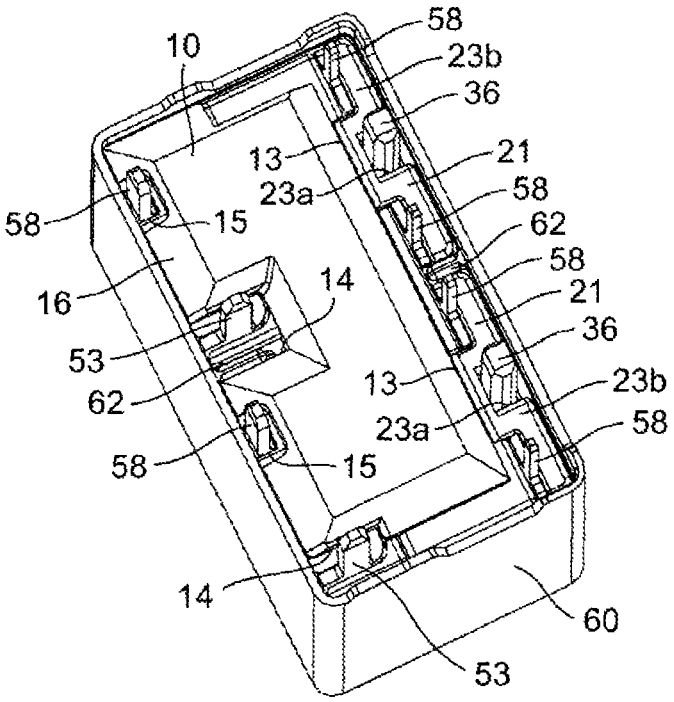

Finally, a sealing member is injected and solidified to be sealed via the taper surface 16 provided along the peripheral edge of the bottom surface of the base 10 shown in FIG. 1B.

According to one or more embodiments of the present invention, a space between the base 10 and the casing 60 is blocked by the seal-retaining ribs 23*b*, 24*c* provided in the guard portions 23, 24. Further, the seal-retaining projected portion 35*a* provided on the outward surface of the yoke 34 is in contact with the inner side surface of the casing 60. Hence it is possible to prevent the sealing member from getting into the casing 60, and prevent the sealing member from adhering to the internal constitutional component such as the movable touch piece 41.

Next, the operation of the electromagnetic relay according to one or more embodiments of the present invention will be described.

Figure 6B:
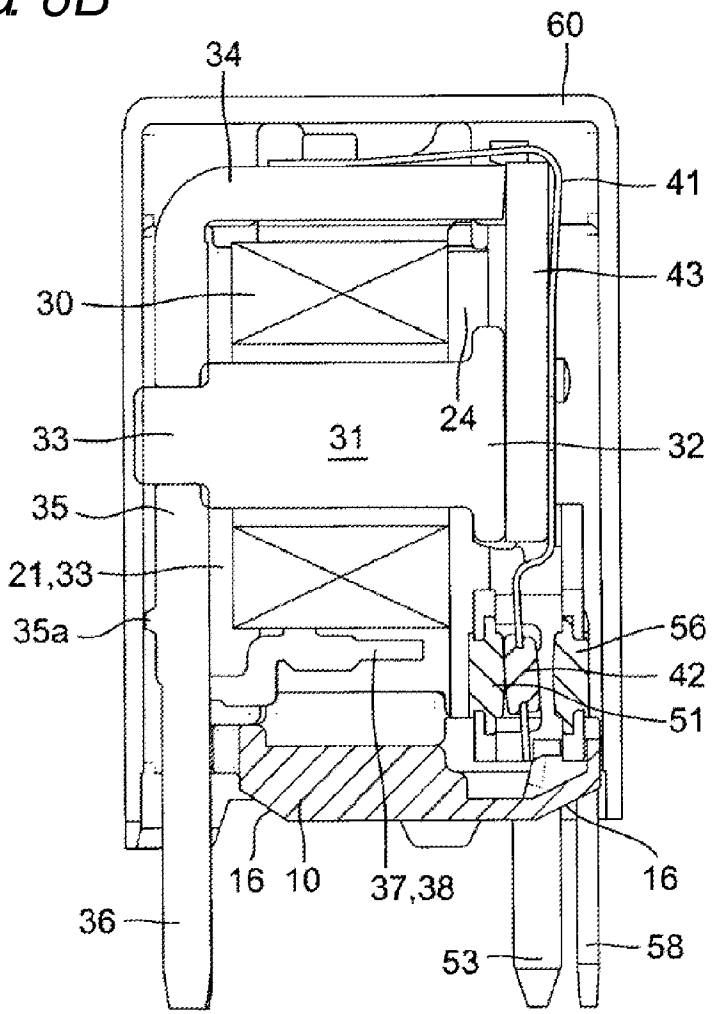
FIGS. 6A and 6B are longitudinal sectional views showing states before and after operation of the electromagnetic relay shown in FIG. 1.
Figure 6A:
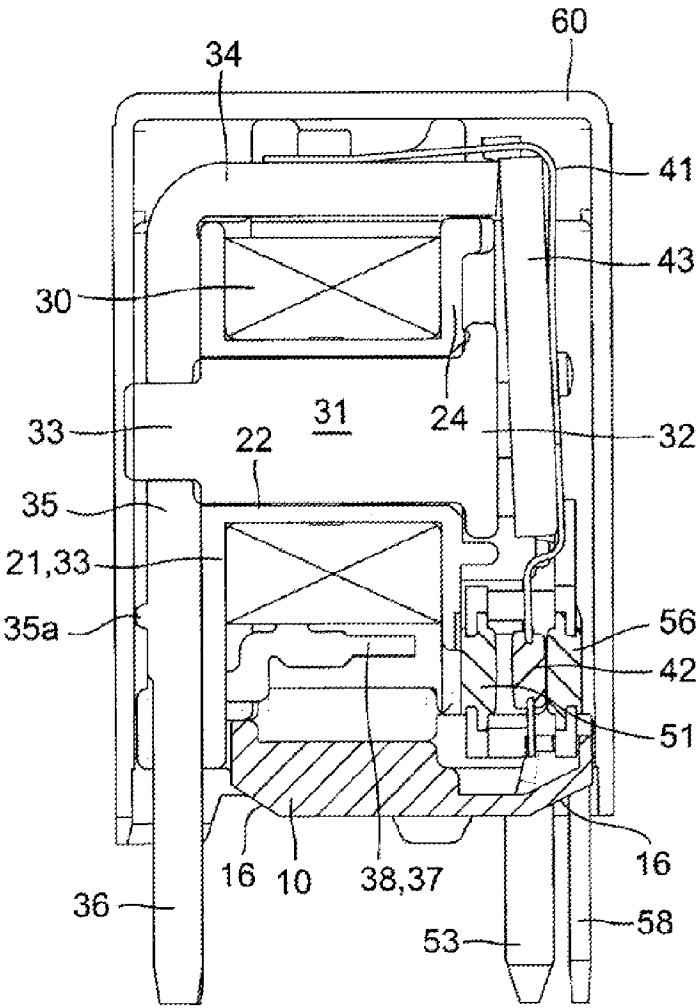

That is, as shown in FIG. 6A, prior to application of a voltage to the coil 30 of the electromagnet block 20, the movable contact 42 is in contact with the normally closed fixed contact 56 due to spring force of the movable touch piece 41.

Then, by applying a voltage to the coil 30 to magnetize it, the movable iron piece 43 is sucked to the magnetic pole portion 32 of the iron core 31 to rotate against the spring force of the movable touch piece 41. Therefore, after the contacts are opened as the movable contact 42 is separated from the normally closed fixed contact 56 and it then comes into contact with the normally open fixed contact 51, the movable iron piece 43 is adsorbed to the magnetic pole portion 32 of the iron core 31 (FIG. 6B).

Subsequently, when the magnetization of the coil 30 is released (demagnetization), the contacts are opened as the movable contact 42 is separated from the normally open fixed contact 51 due to the spring force of the movable touch piece 41, and the movable iron piece 43 rotates in a reverse direction while the movable contact 42 comes into contact with the normally closed fixed contact 56, to restore the original state.

Although the electromagnetic relay including the normally open fixed contact terminal and the normally closed fixed contact terminal has been described in one or more of the foregoing embodiments, it may be applied to an electromagnetic relay having either one of the normally open fixed contact terminal and the normally closed fixed contact terminal.

Further, it may not be restricted to the case of providing a pair of electromagnet blocks, but may be applied to the case of providing one electromagnet block.

Moreover, it may naturally be applied to an electromagnetic relay where the shaft center of the electromagnet block is arranged so as to be orthogonal to the upper surface of the base.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed is:

1. An electromagnetic relay, comprising:

a base comprising an upper surface;

an electromagnet block, which is formed by winding a coil around a spool with at least one end provided with a guard portion and inserting an iron core through a through hole of the spool, mounted on the upper surface of the base such that a longitudinal shaft axis of the iron core is parallel to the base;

a movable contact, which is provided at a free end of a movable touch piece that rotates based on magnetization and demagnetization of the electromagnet block, that is brought into contact with or separated from a fixed contact; and a press-fitting portion that is press-fitted into a press-fitting hole provided at the edge of the outward surface of the guard portion along the shaft center of the iron core, wherein the press-fitting portion extends to the lateral side from a fixed contact terminal that has the fixed contact, wherein the fixed contact is arranged between a pair of press-fitting portions extending in parallel, and wherein the pair of press-fitting portions extending in parallel protrudes from a single fixed contact.

2. The electromagnetic relay according to claim 1, wherein the fixed contact terminal is at least either one of a normally open fixed contact terminal and a normally closed fixed contact terminal respectively comprising a normally open fixed contact and a normally closed fixed contact which are opposed to each other with the movable contact provided therebetween.

3. The electromagnetic relay according to claim 1, wherein the fixed contact terminals are a normally closed fixed contact terminal and a normally open fixed contact terminal respectively comprising a normally closed fixed contact and a normally open fixed contact which are opposed to each other with the movable contact provided therebetween, and wherein press-fitting holes to be press-fitted with press-fitting portions of the normally closed fixed contact terminal and the normally open fixed contact terminal are arranged in upper and lower parts at the edge of the front surface of the guard portion.

4. The electromagnetic relay according to claim 2, wherein the press-fitting portions are respectively cut from a pair of corners formed by bending both-side edges of the normally open fixed contact terminal in the same direction.

5. The electromagnetic relay according to claim 1, wherein the fixed contact terminal is at least either one of a normally open fixed contact terminal and a normally closed fixed contact terminal respectively comprising a normally open fixed contact and a normally closed fixed contact which are opposed to each other with the movable contact provided therebetween.

6. The electromagnetic relay according to claim 1, wherein the fixed contact terminals are a normally closed fixed contact terminal and a normally open fixed contact terminal respectively comprising a normally closed fixed contact and a normally open fixed contact which are opposed to each other with the movable contact provided therebetween, and wherein press-fitting holes to be press-fitted with press-fitting portions of the normally closed fixed contact terminal and the normally open fixed contact terminal are arranged in upper and lower parts at the edge of the front surface of the guard portion.

7. The electromagnetic relay according to claim 3, wherein the press-fitting portions are respectively cut from a pair of corners formed by bending both-side edges of the normally open fixed contact terminal in the same direction.

* * * * *